United States Patent [19]

Allan et al.

[11] Patent Number: 4,600,453

[45] Date of Patent: Jul. 15, 1986

[54] NITRATE ESTER MONOPROPELLANT

[75] Inventors: Barry D. Allan, Huntsville, Ala.; Porter H. Mitchell, Fayetteville, Tenn.

[73] Assignee: The United Stated of America as represented by the Secretary of the Army, Washington, D.C.

[21] Appl. No.: 789,816

[22] Filed: Oct. 21, 1985

[51] Int. Cl.[4] ..... C06B 47/08

[52] U.S. Cl. ..... 149/36; 149/93

[58] Field of Search ..... 149/36, 93

[56] References Cited

U.S. PATENT DOCUMENTS 3,957,550 5/1976 Tannenbaum et al. ..... 149/36

*Primary Examiner*—Stephen J. Lechert, Jr.

*Attorney, Agent, or Firm*—Anthony T. Lane; Robert P. Gibson; Freddie M. Bush

[57] ABSTRACT

The incorporation of a nitrated pentaerythritol additive selected from the mono-, di-, tri-, and tetra-nitrated pentaerythritols into hydrazine is effective in lowering the freezing point of the combination while enhancing the performance of the monopropellant by contributing to the total energy of the monopropellant combination. Hydrazine content varies from about 65 to 95 weight percent while the additive of a nitrated pentaerythritol varies from about 5 to about 25 weight percent. An optional additional additive of methyl alcohol from about 5 to about 20 weight percent can be employed with a corresponding adjustment in weight percent of hydrazine when said additive of methyl alcohol is employed in addition to said additive of said nitrated pentaerythritol.

5 Claims, No Drawings

NITRATE ESTER MONOPROPELLANT

DEDICATORY CLAUSE

The invention described herein may be manufactured, used, and licensed by or for the Government for governmental purposes without the payment to us of any royalties thereon.

BACKGROUND OF THE INVENTION

Monopropellant, as the name implies, is a single propellant ingredient which provides specific impulse (Isp) as it undergoes decomposition from combustion or decomposition by other means such as by catalytic decomposition. A monopropellant generally has a high freezing point and a low Isp. These properties therefore exclude the use of monopropellants in certain tactical situations.

An extensively used monopropellant such as hydrazine has been used as a rocket fuel. Hydrazine has a melting point of 2° C. Hydrazine dissolves many inorganic substances and forms salts with inorganic acids. Hydrazine is miscible with water, methyl, ethyl, propyl, and isobutyl alcohols. Hydrazine forms an azeotropic mixture with water with a boiling point at 760 mm of mercury of 120.3° C.

Although adding water to hydrazine would lower the freezing point of the mixture, the addition of a nonenergetic material would defeat the purpose of achieving a high specific impulse while lowering the freezing point.

Therefore, an object of this invention is to provide a series of additives to a monopropellant to lower the freezing point while enhancing the specific impulse.

A further object of this invention is to provide a series of additives to a monopropellant which are soluble in the monopropellant in sufficient amount to contribute to the specific impulse while lowering the freezing point of the monopropellant thereby enabling the monopropellant with these additives to be used in tactical systems deployed for use in cold environmental conditions.

SUMMARY OF THE INVENTION

The incorporation of the highly nitrated material pentaerythritol tetranitrate, ($C(CH_2ONO_2)_4$), or the mono-, di-, or tri-nitrated pentaerythritols into hydrazine provides a monopropellant whose usefulness can be extended to cold environments while at the same time providing a higher specific impulse system. The addition of methanol, (MeOH) while miscible with hydrazine, acts to further reduce the freezing point of the mixture. Since the nitrated pentaerythritols contribute oxidizer function proportional to the oxygen content, a monopropellant propellant having a variable specific impulse is achieved by varying the amount of the nitrated pentaerythritols as well as varying the selection of the mono- or higher nitrated derivative thereof. This together with a suitable amount of MeOH to lower the freezing point temperature will achieve the desired physical properties. An amount of pentaerythritol tetranitrate from about 5 to about 25 percent by weight has been found to meet the solubility characteristics of hydrazine/MeOH mixture, containing from about 5 to about 20% by weight MeOH, while achieving an enhancement of the specific impulse and at the same time, lowering the freezing point of the mixture to extend its usefulness as a monopropellant in tactical situations subjected to cold environments. Other lower nitrated pentaerythritols are effective in lowering freezing points while achieving a variable specific impulse proportional to the percent additive used and the degree of nitration of the pentaerythritols.

DESCRIPTION OF THE PREFERRED EMBODIMENTS

The monopropellant, hydrazine, combined with an additive in an amount from about 5 to about 25 percent by weight of a nitrated pentaerythritol compound selected from the group consisting of the mono-, di-, tri-, and tetra-, nitrated pentaerythritols results in a lower freezing point, after addition of 5 to 20% MeOH, to thereby extend the usefulness as a monopropellant of a tactical system over a wider environmental temperature range. The monopropellant with the specified additive has a higher specific impulse which increases as the additive weight percent and the total available nitrated groups are increased in the hydrazine. Pentaerythritol tetranitrate is also commonly referred to as PETN. PETN has a carbon content of 18.99%, a hydrogen content of 2.55%, a nitrogen content of 17.72%, and an oxygen content of 60.73%. Methyl alcohol has a carbon content of 37.48%, a hydrogen content of 12.58% and an oxygen content of 49.37%. Thus, the oxygen contribution of MeOH and the lowering of the freezing point of the composition are dual contributions of the additive MeOH.

Table I below sets forth the properties of hydrazine and hydrazine in combination with pentaerythritol tetranitrate and MeOH as additives in various weight percentages.

TABLE I

Properties of Hydrazine and Hydrazine with Additive of Pentaerythritol Tetranitrate (PETN) and Methyl Alcohol (MeOH)

| Composition No | Weight Percent Hydrazine | Weight Percent PETN | Weight Percent Methanol | Melting Point (°C.) | Specific Impulse (lb-sec/lb) | Impact Sensitivity kg/cm |
|---|---|---|---|---|---|---|
| 1 | 100 | 0 | 0 | 2 | 200 | >117 |
| 2 | 95 | 5 | 0 | −3.6 | 205.1 | |
| 3 | 90 | 10 | 0 | −10.7 | 212.4 | |
| 4 | 85 | 5 | 10 | −23.7 | | >117 |
| 5 | 80 | 5 | 15 | | 201.8 | |
| 6 | 80 | 15 | 5 | | 218.7 | >117 |
| 7 | 80 | 10 | 10 | −16.9 | 210.3 | >117 |
| 8 | 80 | 20 | 0 | 10.6 | 226.8 | >117 |
| 9 | 75 | 25 | 0 | −10.9 | | |
| 10 | 65 | 25 | 10 | −16.6 | | |

Table I shows that PETN as an additive to hydrazine raises the specific impulse in addition to lowering the freezing point of the combination thereby rendering the combination usable in colder environmental conditions while improving the performance of the monopropellant by raising the specific impulse.

TABLE II

| Oxygen Weight Percent From Additives PETN* and MeOH** in Composition | | | |
|---|---|---|---|
| Composition No. | $O_2$ Content From PETN | $O_2$ Content From MeOH | Total $O_2$ Content From Additives in Composition |
| 1 | 0 | 0 | 0 |
| 2 | 3.04 | 0 | 3.04 |
| 3 | 6.07 | 0 | 6.07 |
| 4 | 3.04 | 4.94 | 7.98 |
| 5 | 3.04 | 7.41 | 10.45 |
| 6 | 9.11 | 2.47 | 11.58 |
| 7 | 6.07 | 4.94 | 11.01 |
| 8 | 12.14 | 0 | 12.14 |
| 9 | 15.18 | 0 | 15.18 |
| 10 | 15.18 | 7.41 | 22.69 |

*PETN 60.73% $O_2$
**MeOH 49.37% $O_2$

Table II shows the weight percent oxygen content from additives PETN and MeOH in Compositions of Table I. These compositions should have enhanced performance in environmental areas of reduced oxygen content.

In further reference to Tables I and II, compositions can be selected with freezing points ranging from about −3.6° to −23.7° C. with the specific impulses ranging from about 205.1 to 226.8. As an example, where tradeoff between freezing point and specific impulse is desired, composition 7 has a lowered freezing point of −16.9° C. and a specific impulse of 210.3 for an 80/10/10 combination of hydrazine/PETN/MeOH. If, however, a higher specific impulse is desired, but not quite as low a freezing point is required, then the composition No. 8 would be selected whereby the freezing point is −10.6° C. and the specific impulse is 226.8 for the combination of 80/20, hydrazine/PETN. The impact sensitivity is greater than 117 (kg/cm) for selected combinations of hydrazine with additive of PETN and optional additive of MeOH. The improvement in specific impulse while achieving a lowering of freezing point enables the monopropellant with the specified additives to be used in tactical systems deployed for use in cold environmental conditions.

The mono-, di-, or tri-, nitrated pentaerythritols having a lower $0_2$ weight percentage would require a different weight percentage as an additive for comparable oxygen content in the combination. The remaining unnitrated positions on the pentaerythritol renders these compounds more soluble in ethanol, ether and water as compared with PETN; therefore, more affinity for water is an inherent property that should decrease as the degree of nitration increases. The attracted water would be miscible with hydrazine and should produce no problem in the combination. The benefits to lowering freezing point should be comparable with the tetranitrated pentaerythritol while the benefit to specific impulse should be less for the lower nitrated pentaerythritols as compared with the tetranitrated pentaerythritol.

We claim:

1. A nitrate ester monopropellant comprising hydrazine in combination with an additive effective in lowering the freezing point and raising the specific impulse of said combination, said nitrate ester monopropellant combination comprising hydrazine in a weight percent from about 65 to about 95 and a nitrated pentaerythritol in a weight percent from about 5 to about 25 selected from the group consisting of the mono-, di-, tri-, and tetra-nitrated pentaerythritols.

2. The nitrate ester monopropellant of claim 1 wherein said hydrazine is present in an amount of about 80 weight percent and wherein said nitrated pentaerythritol is pentaerythritol tetranitrate which is present in an amount of about 20 weight percent.

3. The nitrate ester monopropellant of claim 1 wherein an optional additional additive of methyl alcohol in a weight percent from about 5 to about 20 is included in said nitrate ester monopropellant with a corresponding adjustment in weight percent of said hydrazine in said nitrate ester monopropellant for said additive amount of methyl alcohol included in said composition.

4. The nitrate ester monopropellant of claim 3 wherein said hydrazine is present in an amount of about 80 weight percent, said pentaerythritol tetranitrate is present in an amount of about 10 weight percent, and said methyl alcohol is present in an amount of about 10 weight percent.

5. The nitrate ester monopropellant of claim 3 wherein said hydrazine is present in an amount of 85 weight percent, said pentaerythritol tetranitrate is present in an amount of about 5 weight percent, and said methyl alcohol is present in an amount of about 10 weight percent.

* * * * *